US005809916A

United States Patent [19]

Strand

[11] Patent Number: 5,809,916

[45] Date of Patent: Sep. 22, 1998

[54] INSERTING DEVICE FOR COILED TUBING

[76] Inventor: Harald Strand, Skoghaug 5, N-4330 Algard, Norway

[21] Appl. No.: 627,363

[22] Filed: Apr. 4, 1996

[30] Foreign Application Priority Data

Jun. 4, 1995 [NO] Norway ..... 951363

[51] Int. Cl.[6] ..... E21B 19/00

[52] U.S. Cl. ..... 166/77.2

[58] Field of Search ..... 166/385, 386, 166/77.2, 77.3

[56] References Cited

U.S. PATENT DOCUMENTS

| | | | |
|---|---|---|---|
| 4,428,421 | 1/1984 | Rankin | 166/77 |
| 4,899,816 | 2/1990 | Mine | 166/85 |
| 4,940,095 | 7/1990 | Newman | 166/378 |
| 5,088,559 | 2/1992 | Taliaferro | 166/379 |
| 5,188,174 | 2/1993 | Anderson, Jr. et al. | 166/77.3 |
| 5,411,085 | 5/1995 | Moore et al. | 166/77.2 X |
| 5,558,153 | 9/1996 | Holcombe et al. | 166/373 |

*Primary Examiner*—William P. Neuder
*Attorney, Agent, or Firm*—Head, Johnson & Kachigian

[57] ABSTRACT

An inserting device for coiled tubing comprises a top drive having a sleeve-shaped through-going shaft and an injector for coiled tubing. The coiled tubing is passed through safety valves, through a packer, as well as through a valve and further through the top drive's sleeve-shaped shaft. The coiled tubing is passed over a guide wheel. Drilling fluid is conducted to the top drive through a hose running over a caster, and a drilling fluid valve. A packer seals around the coiled tubing, and the valve is adapted to be capable of cutting the coiled tubing.

4 Claims, 1 Drawing Sheet

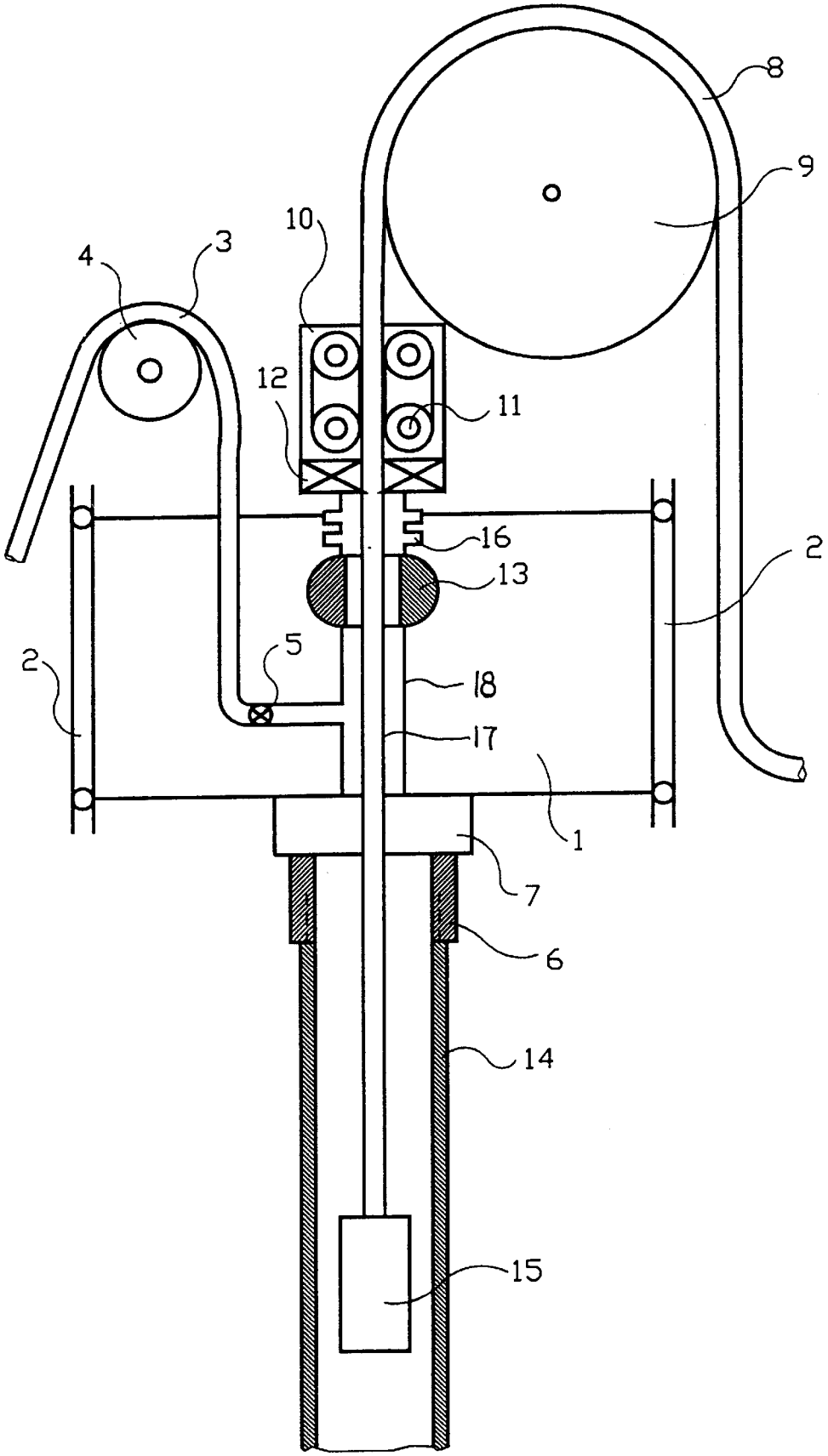
8
9
10
3
4
12
11
16
13
2
2
5
18
17
1
7
6
14
15

INSERTING DEVICE FOR COILED TUBING

This application claims priority from Norwegian Patent Application No. 951363 filed Apr. 06, 1995.

BACKGROUND OF THE INVENTION

1. Field of the Invention

The invention relates to an inserting device for coiled tubing in connection with work in petroleum wells.

2. Background

Coiled tubing has attained an increased use when drilling for oil and gas, especially in deviation wells and wells having a large horizontal extent.

Typically, equipment necessary for use of coiled tubing includes a drum carrying coiled tubing that is placed adjacent to a derrick, usually at the same side as the "V-door", and an inserting device which is suspended from the lifting device or drawworks. The inserting device comprises a curved guide rail or guide channel, often called a swan neck, and a motor-driven pull-forward device adapted to pull the coiled tubing across the swan neck and to push it down into the well or pull it out therefrom.

In connection with prior art technique, it is necessary to carry out a circumstantial mounting and demounting of equipment both prior to a coiled tubing operation and subsequent thereto. Consequently, while the coiled tubing equipment is in use, it is not possible to use the ordinary drilling equipment. On floating platforms, a particular lifting frame is required in order to enable movement compensation of the equipment.

SUMMARY OF THE INVENTION

It is therefore an object of the invention to provide an inserting device for coiled tubing that enables the use of common drilling equipment while equipment for coiled tubing is in place and in use. Examples of common drilling equipment include top drive, drawworks and possibly a heave compensator. Thus, it is a partial objective that an inserting device for coiled tubing enables coiled tubing to be in a position to be fed down through an ordinary drill string while the drill string is in operation. Further, an object is to provide a feed-in device which may be permanently mounted, thus substantially simplifying mounting and demounting of equipment in connection with a coiled tubing operation, as well as carrying out the same without the use of personnel.

The objects are achieved through features as defined in the following claims.

BRIEF DESCRIPTION OF THE DRAWING

FIG. 1 is a side view, partly in section, of a vertically movable hoisting device carrying a top drive and an inserting device for coiled tubing.

DESCRIPTION OF THE PREFERRED EMBODIMENTS

An exemplary embodiment of the invention is described in the following, reference being made to FIG. 1. The figure shows, diagrammatically, in side view and partly in section, a vertically movable hoisting device carrying a top drive and an inserting device for coiled tubing.

In FIG. 1, reference numeral 1 denotes a lifting device or drawworks running along a support structure such as vertical guide rails 2. Hose 3 running over caster 4, is adapted to conduct drilling fluid through drilling fluid valve 5 and further to a through-going, sleeve-shaped shaft 6 on top drive 7 attached to lifting device or drawworks 1. Coiled tubing 8 is guided from a drum, not shown, over guide wheel 9, and is pulled forwardly by means of injector 10 of a type known in the art. Guide Wheel 9 and injector 10 are adapted to be coupled and uncoupled from lifting device 1 to enable the inserting device to be positioned in an upper position within the derrick. Injector 10 carries coiled tubing 8 through packer 12 and through a set of valves 16 comprised of the necessary shutoff/safety valves of a type known in the art. Appropriate shutoff/safety valves are capable of sealing against the outside of the coiled tubing, thereby closing annulus 17 between coiled tubing 8 and channel 18. Packer 12 is adapted to seal against the outside of coiled tubing 8 for sealing annulus 17 but still allow for longitudinal displacement of coiled tubing 8. Coiled tubing 8 additionally passes through valve 13 and further through sleeve-shaped shaft 6 of top drive 7. Valve 13 is adapted to cut coiled tubing 8 in order to close the well in an emergency situation. Pipe 14 may be attached by ordinary methods, e.g., as with drill pipes or casings, to outgoing sleeve-shaped shaft 6 of top drive 7. Thus, pipe 14 may be rotated and also raised and lowered, as well as being pumped through when packer 12 is activated, while coiled tubing 8 is passed down through the pipe 14. Coiled tubing 8 may, as is customarily known, be affixed to equipment 15, such as a drilling motor, perforating equipment, impact/stroke tools, packers and other devices.

The drum, not shown, for coiled tubing 8 may advantageously be located laterally of the derrick, so that access to the "V-door" of the derrick is not prevented.

What is claimed is:

1. An inserting device for coiled tubing, comprising:

vertical guide rails;

a lifting device having a top and a bottom, said lifting device slidably affixed to said vertical guide rails;

a top drive affixed to said bottom of said lifting device;

said top drive provided with a through-going sleeve-shaped shaft through which the coiled tubing is passed;

an injector positioned on said top of said lifting device for carrying the coiled tubing through said sleeve shaped shaft; and a guide wheel positioned above said injector, said guide wheel for the coiled tubing.

2. An inserting device for coiled tubing according to claim 1, further comprising:

a channel defined by said lifting device and passing through said lifting device, said channel for receiving the coiled tubing;

a valve disposed in said channel, said valve capable of cutting the coiled tubing and closing said channel;

a set of valves adapted to be capable of sealing against the coiled tubing and closing an annulus between the coiled tubing and said channel; and a packer adapted to seal against the coiled tubing and seal said annulus, said packer simultaneously allowing longitudinal displacement of the coiled tubing.

3. An inserting device for coiled tubing according to claim 1, further comprising a hose to supply drilling fluid, said hose terminating at said channel.

4. An inserting device for coiled tubing according to in claim 1, wherein said guide wheel and said injector are adapted to be coupled to said lifting device and to be uncoupled from said lifting device, thereby enabling the inserting device to be positioned in an upper position within a derrick.

* * * * *